US007103510B2

(12) United States Patent
Moolman et al.

(10) Patent No.: US 7,103,510 B2
(45) Date of Patent: Sep. 5, 2006

(54) LOGGING OF DETONATOR USAGE

(75) Inventors: Jacques Wessel Moolman, Vanderbijlpark (ZA); William Blake, Klerksdorp (ZA)

(73) Assignee: Orica Explosives Technology Pty Ltd., Melbourne (AU)

( * ) Notice: Subject to any disclaimer, the term of this patent is extended or adjusted under 35 U.S.C. 154(b) by 12 days.

(21) Appl. No.: 10/954,243

(22) Filed: Oct. 1, 2004

(65) Prior Publication Data

US 2005/0131655 A1 Jun. 16, 2005

(30) Foreign Application Priority Data

Oct. 2, 2003 (ZA) ..... 2003/7698

(51) Int. Cl.
*G06F 15/00* (2006.01)
*F42B 3/00* (2006.01)

(52) U.S. Cl. ..... 702/187; 102/311; 102/313

(58) Field of Classification Search ..... 702/187; 102/301, 311, 313, 106
See application file for complete search history.

(56) References Cited

U.S. PATENT DOCUMENTS 4,674,047 A * 6/1987 Tyler et al. ..... 89/28.05
6,085,659 A * 7/2000 Beukes et al. ..... 102/206
6,349,648 B1 * 2/2002 Capers et al. ..... 102/275.4

* cited by examiner

*Primary Examiner*—Bryan Bui
*Assistant Examiner*—Meagan S Walling
(74) *Attorney, Agent, or Firm*—Birch, Stewart, Kolasch and Birch, LLP

(57) ABSTRACT

A method of logging use of a non-electric detonator, which comprises recording identity data associated with the detonator at the time the detonator is being loaded in a blasthole, recording consumption of the detonator, and relating the identity data associated with the detonator to an inventory of non-electric detonators thereby allowing the inventory to be updated, wherein the identity data associated with the non-electric detonator are recorded using an electronic device.

17 Claims, 2 Drawing Sheets

LOGGING OF DETONATOR USAGE

Figure 1:
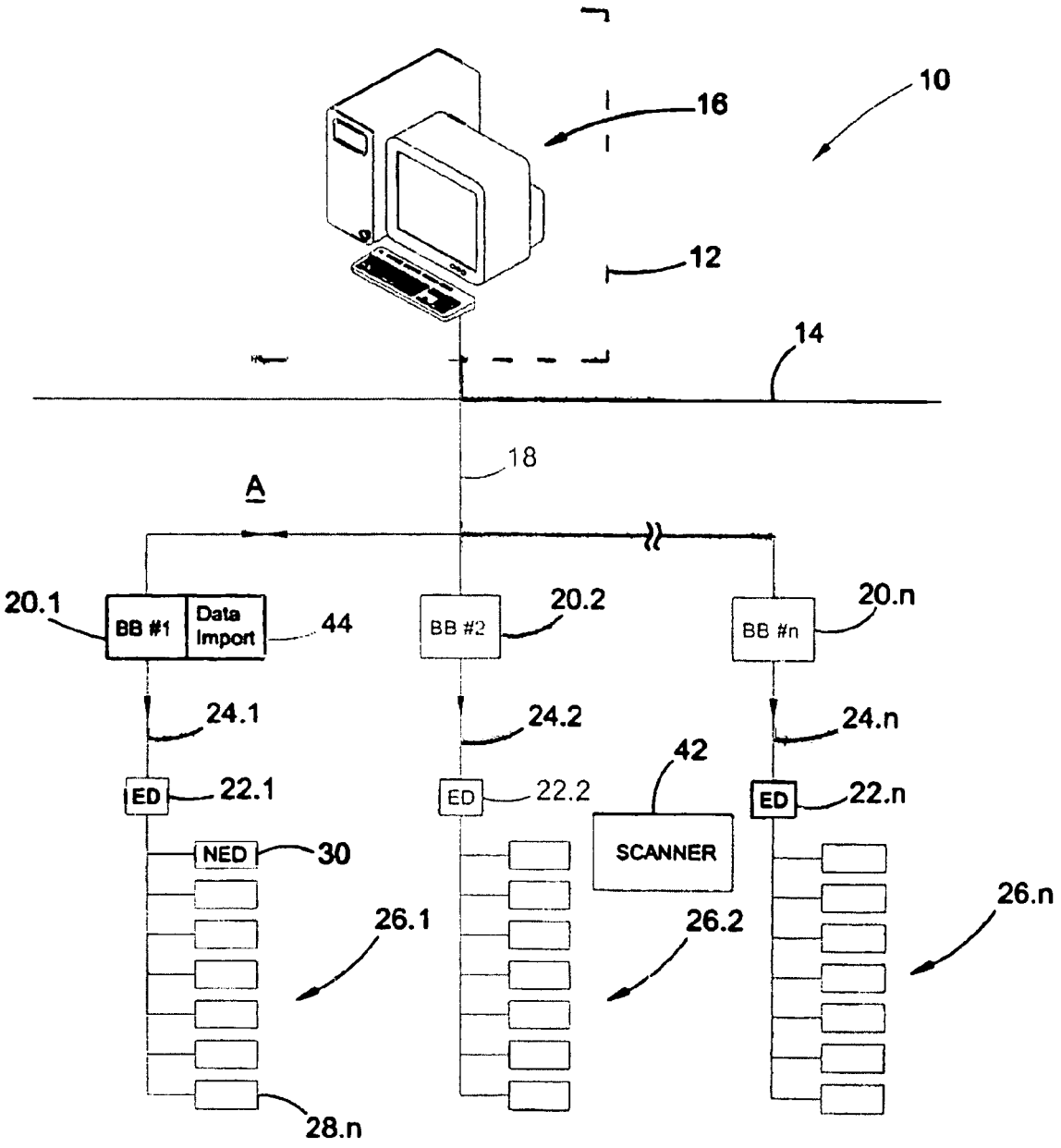

This Nonprovisional application claims priority under 35 U.S.C. § 119(a) on Patent Application No(s). 2003/7698 filed in South Africa on Oct. 2, 2003, the entire contents of which are hereby incorporated by reference.

The present invention relates to a method of logging the use of non-electric detonators for initiating explosives mining operations.

Most known electronic detonators carry some form of identity data or address that enables electronic programming of the detonators when a group of them is used in a single blast. When full programmability from a blast controller is required, each detonator must be individually adressable. Such programmability therefore requires each detonator to have a unique identity code/address. To ensure compliance with a particular blast design, in use the detonator code/identity address may be conveyed electronically to the blast controller before a blast is initiated. In this way the blast controller has a record of the electronic detonator associated with the blast. In turn, this record can be incorporated into a data management system in order to keep a record of detonator usage. An example of a blasting system that relies on this type of approach to logging of detonator usage is described in WO 00/60305.

The ability to keep track of detonator usage has obvious benefits in terms of security and resource management and the methodology described in WO 00/60305 is advantageous since it is to a large extent automated and the potential for error and/or interference is minimal. The methodology is readily applicable to electronic detonators as a consequence of the fact that such detonators are able to communicate their identity data to a blast controller.

However, the same approach cannot be translated to non-electric detonators since they do not have the same attributes as electronic detonators that enable the methodology described to be implemented. There therefore remains the need to provide a means of logging usage of non-electric detonators. It would be particularly valuable to provide such means that is automated and that is therefore easy and convenient to implement, that has a high level of accuracy and that has little scope for error and/or outside interference.

Accordingly, the present invention provides a method of logging use of a non-electric detonator, which comprises recording identity data associated with the detonator at the time the detonator is being loaded in a blasthole, recording consumption of the detonator, and relating the identity data associated with the detonator to an inventory of non-electric detonators thereby allowing the inventory to be updated, wherein the identity data associated with the non-electric detonator are recorded using an electronic device.

Fundamental to the present invention is the fact that the non-electric detonator has associated identity data that may be recorded using some form of electronic device. This enables tracking of the detonator during transport, storage and use. Thus, in accordance with the invention it is possible to monitor and keep record of the detonator leaving a manufacturing facility, receipt of the detonator into a store (magazine), removal of the detonator from the store and use of the detonator in a blasting operation. The identity data therefore allows movement and use of the detonator to be monitored and stored as an electronic record. In turn, this record can be used in a variety of ways to provide important information about detonator usage. For example, the detonator identity data may be used of the purposes of traceability, tracking usage for regulatory compliance, production record keeping, security and resource management.

The identity data associated with the non-electric detonator may take a variety of forms. In one embodiment the identity data may take the form of a bar code provided on an external surface of the detonator, or on a tag attached to or associated with the detonator. In this case the electronic device used for recording the identity data will be a hand held bar code reader that has the ability to record the identity data and to convey the data for subsequent use as required. The use of bar codes and bar code readers is widespread and conventional technology may be applied in this regard.

It is known to apply bar codes to certain types of detonator during the production process in order to keep records of production. However, these bar codes have hitherto not been used as part of a system for monitoring detonator usage during blast preparation. A method of marking detonators disclosed in CN 1349895 involves computerised equipment that has high efficiency and accuracy, and that results in markings that are difficult to forge.

In another embodiment the identity data for the non-electric detonator may be stored in a radio frequency identification (RFID) tag associated with the detonator. In this case the electronic device for recording the identity data will be some form of radio frequency reader for the tag. Again, conventional technology may be used in this regard.

When the identity data are provide on some form of tag associated with the detonator, it is important that the tag is securely fastened to the detonator so that the tag will not become detached.

It is preferable that the identity data are associated with the detonator in such a way that is readily accessible so that reading of the data with a suitable electronic device is simple and rapid. In one embodiment the identity data are associated with a connector that is used to connect the detonator to a bus line, or the like, as would be the case in practice during use of the detonator. For the purposes of using identity data in the form of a bar code, it is important that the bar code is applied to a relatively smooth and flat surface to ensure readability.

Usually, in a blasting operation numerous non-electric detonators may be used, and it is envisaged that the use of each detonator will be logged in accordance with the present invention. Each detonator may have associated identity data that is unique to it. In this case the electronic device will maintain a record of each detonator as an individual and unique record entry. Alternatively, the identity data may be the same as between a given number of detonators and in this case the electronic device used for reading the identity data will function as an electronic counter for each detonator used. This level of information recordal may suffice in many instances. In another embodiment the identity data may be the same for a given detonator design, type or delay time. This provides further options in terms of how the data recorded may be used.

The invention is applicable to a variety of non-electric detonators. Typically, however, the non-electric detonator is a shock tube detonator.

The method of the invention involves recording identity data associated with a non-electric detonator at the time the detonator is being loaded into a blasthole. In other words the identity data are recorded when the detonator is being used in the field in a blasting operation. Typically, a number of non-electric detonators will be used in a single blasthole. Preferably, the identity data are recorded immediately before each detonator is loaded in the blasthole. It is also preferred that loading of the blasthole is completed, for example with bulk explosive and possibly stemming, as soon as possible after the identity data of each detonator have been recorded and each detonator loaded in a blasthole. Proceeding in this way minimises the time available for possible unauthorised removal of a detonator after the detonator identity data have been recorded.

To provide as reliable record as possible of detonator usage, detonator consumption (in the blasthole) is also recorded. This will require some form of monitoring step. This may be done simply by inspection that each blasthole in a blast field has been detonated, the assumption then being that each detonator in the respective blastholes has been fired or any unfired detonator(s) are destroyed and/or irretrievable. Herein the term "consumption", and variations thereon, are used to encompass these various possibilities. The important point is that once "consumed" a detonator is no longer available for subsequent retrieval and possible use. Where a single detonator is associated with a blasthole, failure of the blasthole to fire is indicative of the fact that the non-electric detonator has not been fired. Where a number of non-electric detonators are used in a single blasthole, firing of the blasthole must mean that at least one of these detonators has been fired.

Preferably, there is the minimum delay between loading and firing of the blastholes since this minimises the time available for unauthorised removal of detonator(s) from the blastholes. However, for large blasting operations, the loading process may take days or even weeks and in this case it is important for loaded blastholes to be guarded to protect against unauthorised removal of detonators. This said, once a blasthole has been fully loaded, removal of a detonator is typically very difficult. It is also likely to be evident on inspection whether a loaded but as yet unfired blasthole has been tampered with.

It is preferred to keep an electronic record of detonator consumption during a blasting operation and this may be done using the same electronic device as used for reading detonator identity data, or a different electronic device. Either way it is important that a record of a detonator being loaded into a blasthole can be related to a record of that detonator being consumed during firing of a blasthole in a blasting operation.

In a preferred embodiment consumption of a non-electric detonator in a blasthole is recorded electronically by recording actual destruction of another detonator loaded in the same blasthole. In this case detonation of the another detonator may be used as a means for initiating detonation of the non-electric detonator. In this embodiment the another detonator may be a programmable electronic detonator that itself has identity data associated with it and that is able to report electronically to a blast controller a ready-to-fire signal immediately prior to detonation. In this way actual detonation of the electronic detonator can be recorded, and this record can be taken as being representative of consumption of the or each non-electric detonator in the same blasthole as the electronic detonator (assuming the blasthole is detonated). In this case the identity data associated with the electronic detonator is also preferably recorded as being associated with the or each non-electric detonator present in a given blasthole.

As an alternative, the "another detonator" is an electric detonator and in this case actual destruction of the electric detonator may be recorded based on measurements of firing circuit resistance, that is the cumulative value of the resistance of each detonator and firing cable resistance in a series firing circuit.

Monitoring and recording of actual detonation of programmable electronic detonators and electric detonators is descried in more detail in WO 00/60305 and this is therefore a useful reference in relation to this particular embodiment of the present invention.

In another embodiment of the invention initiation of a non-electric detonator may be recorded using a remote firing system for the non-electric detonator. Remote firing systems have been developed to provide an alternative to safety fuse and cable based firing systems. Essentially such systems allow remote and centralised blasting control using a wireless (radio) link between a blast controller and the blast site. The remote firing system may be used to initiate shock tube directly.

A variety of commercially available remote firing systems exist and they typically comprise a control unit and a remote initiator unit that are able to communicate with each other by two-way radio signals including encoded operational and reporting commands. The remote initiator unit usually includes an electrical energy store, such as a capacitor, that is charged on receipt of a suitable command from the control unit and discharged on receipt of another suitable signal from the control unit. Discharge takes place into a signal tube sparker/initiator thereby triggering firing of the shock tube.

Operation of this kind of remote firing system to initiate a non-electric detonator may be recorded electronically and this record may also be taken as being representative of consumption of the non-electric detonator. An example of a commercially available remote firing system that may be useful in practice of the present invention (with suitable modification as might be required) is BlastPED EXEL available from Mine Site Technologies.

To log detonator usage, the identity data of a non-electric detonator are related to an inventory of non-electric detonators. The inventory is typically a store (or magazine) of non-electric detonators that itself is characterised by reference to identity data associated with each detonator in the store. The inventory may be updated depending upon the type of identity data associated with the non-electric detonators. Thus, if the detonators are identified by reference to identity data that is unique to each detonator, the inventory will be updated based on the use of that individual detonator. Alternatively, if detonators in a store have the same identification data, the inventory will simply be updated based on the number of detonators that are used.

The inventory may be updated subsequent to loading of non-electric detonators during blast preparation. Alternatively, the inventory may be updated subsequent to detonator consumption. This would provide a real time measure of detonator usage.

Data relating to use of a non-electric detonator, including consumption thereof, may be incorporated in a data management system for a variety of purposes including resource management accounting, security and usage reporting. The data gathered during application of the method of the invention in a blasting operation is preferably in a form that may be downloaded or communicated with other data management systems that might be used. The device used to record the identity data associated with a non-electric detonator may be configured accordingly to interface as necessary with other system components that are used for data management and possibly analysis. Data stored in the device may be downloaded over a physical link or through some form of wireless communication protocol. Methods of data suitable transmission are known in the art. Preferably, data from the device are transmitted essentially instantaneously to a remote location where the inventory can be updated in real time, or as close thereto as possible.

In a preferred embodiment data recorded by the device are automatically transmitted to a remote data management system, where the data can be reconciled against an inventory of non-electric detonators. Where data relating to consumption of a non-electric detonator are also recorded, it is also preferred that the data are also transmitted automatically to the data management system. This offers increased security and ensures that data relating to usage is gathered and relayed without delay.

Figure 2:
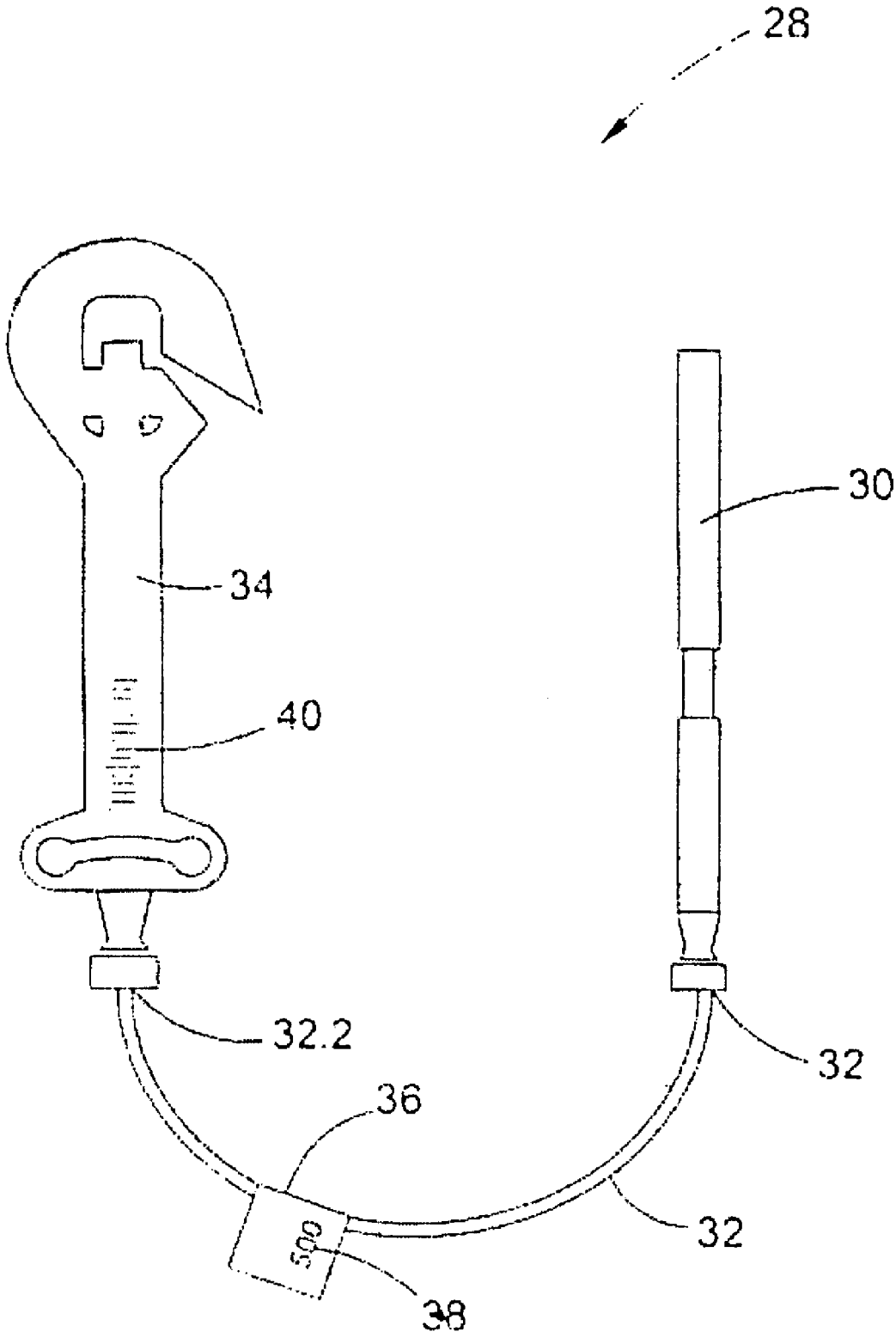

Embodiments of the present invention will now be described, by way of example only, with reference to the accompanying diagrams wherein:

FIG. 1 is a block diagram of a blasting system incorporating the methodology of the invention; and FIG. 2 is a diagram of a non-electric detonator, in the form of a shock tube detonator assembly useful in practice of the invention.

In FIG. 1 there is shown a block diagram of a multi-shot blasting system, such as a sequential blasting system, generally designated by the reference numeral 10. The system comprises a central control station 12, which in some mining applications may be an above surface 14 station. The station comprises computer system 16. The system is connected via a bi-directional data network 18 to at least one, but preferably a plurality of blast boxes 20.1 to 20.n. Each blast box is connected to a respective electronic detonator 22.1 to 22.n via a respective unidirectional communication line 24.1 to 24.n.

Connected to electronic detonators 22.1 to 22.n are arrangements 26.1 to 26.n of non-electric detonators respectively. These arrangements are the same and therefore arrangement 26.1 only will be described in more detail hereinafter.

A typical detonator assembly is shown at 28 in FIG. 2. The arrangement 26.1 comprises a plurality of non-electric, typically shock tube detonator assemblies 28.1 to 28.n connected in known manner in train configuration to the electronic detonator 22.1.

The assembly 28 shown in FIG. 2 comprises a known non-electric detonator (NED) 30 which is connected at a first end 32.1 of a length of shock tube 32. A second end of the shock tube 32 is connected in known manner to a known connector 34. Intermediate ends 32.1 and 32.2, but towards end 32.2, there is provided in known manner a conventional tag 36 having printed thereon in human readable and perceivable form a delay time indication 38 associated with the assembly 28. Each assembly 28 further comprises a device readable insignia, typically a bar code 40, applied to the assembly and representing identification data of the detonator. The bar code is provided on a suitable surface in a region towards connector 34, preferably in a region between the tag 36 and the connector 34, both inclusive.

Returning to FIG. 1, the system 10 further comprises a portable bar code reader or scanner 42 for reading the bar code associated with the non-electric detonators 30.

In use, the detonators 30 of the arrangements 28.1 to 28.n are inserted into respective holes (not shown) in a face of a panel (also not shown) to be removed by the blast. The detonator assemblies are connected to one another as described hereinbefore via the connectors 34, which are located adjacent the face of the panel to form the arrangement 26.1 shown in FIG. 1.

During blast preparation, an operator utilises scanner 42 automatically to read the bar code 40 on each detonator assembly in the arrangement. The scanner 42 comprises data output means (not shown) which may be brought into data communication with data input means 44 on the blast box 20.1. The data read and collected by the scanner 42 is transferred to the blast box or an interface connected thereto. This data is then communicated in direction A on network 18 to the computer system 16 at station 12. In this manner the ID codes of all detonator assemblies 28.1 to 28.n connected to blast box 20.1 are automatically read and recorded.

Once a blast initiate command is transmitted in direction B from station 12 to the blast box 20.1, the computer system 16 records that the detonator assemblies 28.1 to 28.n, with identification data recorded and stored as explained hereinbefore, were consumed.

In a further embodiment of the invention, a plurality of detonator assemblies could be connected to a single, standalone blast box in the performance of a single blast. The record of detonator assemblies used will be stored locally in this blast box and/or in the hand-held scanner for later up-loading to a data management system.

In another embodiment the electronic detonators 22.1 to 22.n may have bi-directional communication capability that allows actual firing of the electronic detonator to be recorded on the basis of a ready-to-fire signal prior to firing, as described above.

It will be appreciated that there are many variations in detail on the system, detonator assembly and method according to the invention without departing form the scope and spirit of this disclosure.

The invention claimed is:

1. A method of logging use of a non-electric detonator, which comprises recording identity data associated with the detonator at the time the detonator is being loaded in a blasthole, recording consumption of the detonator, and relating the identity data associated with the detonator to an inventory of non-electric detonators thereby allowing the inventory to be updated, wherein the identity data associated with the non-electric detonator are recorded using an electronic device, wherein the identity data associated with the non-electric detonator are recorded immediately before the detonator is loaded in the blasthole.

2. A method according to claim 1, wherein the non-electric detonator is a shock tube detonator.

3. A method according to claim 1 or 2, wherein the identity data takes the form of a bar code provided on an external surface of the detonator, or on a tag attached to or associated with the detonator, and the electronic device used for recording the identity data is a hand held bar code reader.

4. A method according to claim 1 or 2, wherein identity data for the non-electric detonator are stored in a radio frequency identification (RFID) tag associated with the detonator, and the electronic device for recording the identity data is a radio frequency reader for the tag.

5. A method according to claim 1, wherein a number of non-electric detonators are employed, each detonator having associated identity data that are unique to each detonator, and wherein the electronic device maintains a record of each detonator as an individual and unique record entry.

6. A method according to claim 1, wherein a number of non-electric detonators are employed, the identity data being the same for each detonator, and wherein the electronic device used for reading the identity data functions as an electronic counter for each detonator.

7. A method according to claim 1, wherein loading of the blasthole is completed as soon as possible after the identity data of the detonator have been recorded and the detonator loaded in the blasthole.

8. A method according to claim 1, wherein consumption of the non-electric detonator is recorded electronically by recording detonation of another detonator loaded in the same blasthole.

9. A method according to claim 8, wherein detonation of the another detonator is used to initiate detonation of the non-electric detonator.

10. A method according to claim 8 or 9, wherein the another detonator is a programmable electronic detonator that itself has identity data associated with it and that is able to report electronically to a blast controller a ready-to-fire signal immediately prior to detonation.

11. A method according to claim 8 or 9, wherein the another detonator is an electric detonator and actual detonation of the electric detonator is recorded based on measurements of firing circuit resistance.

12. A method according to claim 1, wherein consumption of the non-electric detonator is recorded electronically based on operation of a remote firing system for the non-electric detonator.

13. A method according to claim 1, wherein the inventory is updated subsequent to loading of the non-electric detonator in a blasthole during blast preparation.

14. A method according to claim 1, wherein the inventory is updated subsequent to detonator consumption.

15. A method according to claim 1, wherein the electronic device used to record the identity data associated with the non-electric detonator is configured to interface as necessary with system components that are used for data management.

16. A method according to claim 1, wherein data recorded by the electronic device are automatically transmitted to a remote data management system, where the data can be reconciled against an inventory of non-electric detonators.

17. A method according to claim 16, wherein data relating to consumption of the non-electric detonator are also recorded and these data are also transmitted automatically to the data management system.

* * * * *